US006192629B1

(12) United States Patent
Akins et al.

(10) Patent No.: US 6,192,629 B1
(45) Date of Patent: Feb. 27, 2001

(54) TWO-WAY GATE

(75) Inventors: Allan Akins, St. Boniface, Manitoba (CA), R2H 3B4; Joe Kuffner; Len Peters, both of St. Boniface (CA)

(73) Assignee: Allan Akins, Manitoba (CA)

( * ) Notice: Subject to any disclaimer, the term of this patent is extended or adjusted under 35 U.S.C. 154(b) by 0 days.

(21) Appl. No.: 09/325,939

(22) Filed: Jun. 4, 1999

(30) Foreign Application Priority Data

Sep. 30, 1998 (CA) ..... 2249100

(51) Int. Cl.[7] ..... E05D 7/02; E05D 15/50

(52) U.S. Cl. ..... 49/382; 49/193; 292/67

(58) Field of Search ..... 49/192, 193, 246, 49/382, 386, 381; 292/DIG. 17, 4, 5, 56, 67, 120, 63, 64, 71; D8/331

(56) References Cited

U.S. PATENT DOCUMENTS 795,539 * 7/1905 Parmelee ..... 16/231
890,368 * 6/1908 Montgomery ..... 16/232
1,505,039 8/1924 Lay .
2,724,142 * 11/1955 McNabb ..... 49/386 X
2,822,630 2/1958 Guyer .
3,030,717 4/1962 Lewis .
3,300,898 1/1967 Etnyre .
3,411,241 * 11/1968 Harmon ..... 49/386
3,751,084 * 8/1973 Lening ..... 16/231 X
4,047,332 * 9/1977 Benoit ..... 49/386 X

* cited by examiner

*Primary Examiner*—Daniel P. Stodola
*Assistant Examiner*—Hugh B. Thompson
(74) *Attorney, Agent, or Firm*—Middleton Reutlinger; Charles G. Lamb

(57) ABSTRACT

A gate assembly includes a gate disposed between two vertical columns with attaching members on opposite sides of the gate and engagable with the vertical columns. The locking mechanism includes a U-shaped hinge member fixedly attached on each side of a gate panel and a pivoting U-shaped latching member attached to each side of a gate panel, a hinge-U of the hinge member and a latch-U of the latch member being in cooperating relation when engaged with the vertical columns to lock a gate in a closed position. The gate assembly provides that the locking mechanism is operable on both sides of the gate.

9 Claims, 5 Drawing Sheets

TWO-WAY GATE

This invention deals with the field of gates for closing an opening in a wall, fence or so forth, and in particular with such a gate that hinges and latches on both ends.

BACKGROUND

The value of two-way gates that will both hinge and latch on each side is well known. Examples of such prior gates are disclosed in U.S. Pat. No. 3,300,898 to Etnyre; U.S. Pat. No. 3,030,717 to Lewis; U.S. Pat. No. 2,822,630 to Guyer and U.S. Pat. No. 1,505,039 to Lay.

The devices disclosed in these patents all provide the advantages that they may be opened. from either side, and in fact in either direction from either side, and can be completely removed easily. There however are disadvantages associated with each.

It is a distinct advantage to be able to simply push or slam a gate closed and have it latch in place automatically. Only the gate of Guyer may, in one embodiment, be closed by simply pushing or slamming the gate closed. All the others require relatively precise placement of the gate relative to the gate post, and subsequent manual lifting or latching. In the Gruyer embodiment, when the gate is slammed a hole in a bracket falls over a pin. The embodiment incorporates a fairly complex linkage wherein tolerances must be kept within a limited range. Because of the need to maintain these tolerances, the embodiment would not be suitable for the rough treatment many gates, especially those for use with livestock, are subjected to.

This rough treatment often results in bent and deformed gates or gate posts. None of the prior art gates provide any adjustment to allow the working parts to be adjusted to compensate for deformed gates or gate posts.

Only the gate of Lay does not require hinge parts projecting from the fixed sides of the opening when the gate is open. These projecting parts are dangerous to persons, vehicles, livestock and so forth passing through the gate. While the Lay gate has no such projecting parts, it leaves an open hole in the ground when the gate is open, which is also dangerous. This hole is also liable to be filled with soil, snow and so forth unless the socket pipe defining the hole is raised which would again present a danger to traffic passing through the gate.

Only the gate of Lay may slide vertically up to a certain degree and still function properly. This ability is an advantage where snow or such might block a gate.

SUMMARY OF THE INVENTION

It is an object of the present invention to provide a gate that may be opened from either end.

It is a further object of the present invention to provide such a gate that leaves no projections inside the gate post when the gate is open.

It is a further object of the present invention to provide such a gate that may will latch closed automatically when pushed into a closed position.

The invention accomplishes these objects providing a gate operable so as to open from either end thereof, said gate comprising an opening defined on each side by a vertical column, said vertical columns having inner sides facing each other across the width of the opening, and outer sides opposite said inner sides; a gate panel having two ends and two sides; a fixed U-shaped top hinge member extending from an upper portion of each end of said gate panel and a fixed U-shaped bottom hinge member extending from a lower portion of each end of said gate panel such that the open ends of said U-shaped hinge members are aligned towards one side of said gate panel and aligned with said vertical columns such that when said gate is closed each said U-shaped hinge member engages said vertical columns such that a first leg thereof lies on said inner side of one of said vertical columns, substantially perpendicular to said opening and the second leg thereof lies on said outer side of one of said vertical columns, substantially perpendicular to said opening; a support member extending radially from each said vertical column such that the bottom edge of one said hinge member on each end of said gate is supported thereby when that end of said gate is closed; a U-shaped latch member pivotally attached about a vertical axis to each end of said gate panel such that said latch members may pivot from a closed position engaging said vertical columns such that the legs of said latch members are substantially perpendicular to the legs of said hinge members, thereby securing said hinge members to said vertical columns, to an open position wherein said legs of said latch members are at an acute angle to said legs of the hinge members, thereby releasing said hinge members to be moved away from said vertical columns; controls to selectively lock said latch members into said closed position and to release said latch members, allowing said latch members to pivot into said open position.

Such a gate would not be operable to swing in or out, but could be easily removed by unlatching both ends and put in position so as to swing the opposite direction if so desired, for example into a pen instead of out of the pen. Such a gate would provide a passage way through the open gate with no projections into same or other hazards such as a hole in the ground. Such a gate would also freely move up on the vertical columns to avoid obstructions.

The control could comprise biassing means to lock the latch member into the closed position when the legs of the latch member are pivoted into the closed position. The pivotal attachment of the latch members to the ends of the gate panel could comprise a vertical pin fixed to the closed end of the U of each the latch member, the pin engaging a vertical aperture defined by a member fixed to the gate panel, the pin and latch member thereby free to rotate and to move vertically in the aperture, the latch member thus being able to pivot from a closed to an open position.

The controls could comprise a block fixed to the gate panel such that when the latch member is in the closed position, the latch member is held in a bottom vertical position by the biassing means wherein the block prevents pivoting of the latch member. Raising means could be provided to raise the latch member against the biassing force to an upper vertical position wherein the latch member may pivot over the top of the block and rest on the block in the open position when the raising means is released. In this way, when the gate is pushed shut or slammed, the latch member will pivot into the closed position as it contacts the vertical column, and be pushed down into the closed and latched position by the biassing force, thus providing a gate that latches closed automatically when slammed..

To provide maximum strength, a latch member could be provided vertically adjacent to each the hinge member. The controls could comprise a vertical lifting member joining the latch members on each end of the gate panel, thereby simultaneously raising both such latch members so they would be free to pivot over the blocks into an open position, thereby allowing the hinge members to move away from the vertical column and the gate to open.

Conveniently, the vertical apertures could be defined by the hinge members and the blocks could be fixed to the top of the hinge members.

The fixed position of the U of the hinge members relative to the gate panel could be adjustable closer to or farther from the gate panel, thereby allowing accommodation for bent or deformed gates.

The support members could extend from the outer sides of the vertical columns, thereby supporting the hinge member as it rotates on the vertical column when the gate is swung open from the opposite end without risk of the open end of the hinge U aligning with the support member, at which point the gate would slide down the vertical column. This position also keeps the inner sides of the vertical columns free from projections. Rails attached to the vertical columns as part of a fence could conveniently serve as support members.

The hinge members, latch members, support members and controls could conveniently be supplied in a kit for installation on a gate.

In another aspect the invention provides a gate operable so as to open from either end thereof, said gate comprising an opening defined on each side by a vertical column, said vertical columns having inner sides facing each other across the width of the opening, and outer sides opposite said inner sides; a vertically planar gate panel having a first end and a second end and further having a first side and a second side; a fixed U-shaped top hinge member extending from an upper portion of each end of said gate panel and a fixed U-shaped bottom hinge member extending from a lower portion of each end of said gate panel such that the open ends of said U-shaped hinge members are aligned towards one side of said gate panel and aligned with said vertical columns such that when said gate is closed each said U-shaped hinge member engages said vertical columns such that a first leg thereof lies on said inner side of one of said vertical columns, substantially perpendicular to said opening and the second leg thereof lies on said outer side of one of said vertical columns, substantially perpendicular to said opening; a support member extending radially from each said vertical column such that the bottom edge of one said hinge member on each end of said gate is supported thereby when that end of said gate is closed; a latch operable to lock said U-shaped hinge members into engagement with said vertical columns when said gate is closed.

The latch could comprise a U-shaped latch member wherein the legs of the U are separated by a vertical distance, the latch member pivotally attached about a vertical axis to each end of the gate panel such that the latch members may pivot from a closed position engaging the vertical columns such that the legs of the latch members are substantially perpendicular to the legs of the hinge members, thereby securing the hinge members to the vertical columns, to an open position wherein the legs of the latch members may pivot, allowing the hinge members to be moved away from the vertical columns. Thus the latch member would act in a similar manner to the U-shaped latch member described above. The fact that one leg of the U was vertically removed from the other would not change the action thereof so long as the legs are fixed with respect to each other.

In a simple embodiment, the latch means could simply comprise a bar operable to close the open end of the U of the hinge member when the hinge member is engaged in the vertical column.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE EMBODIMENT

Figure 1:
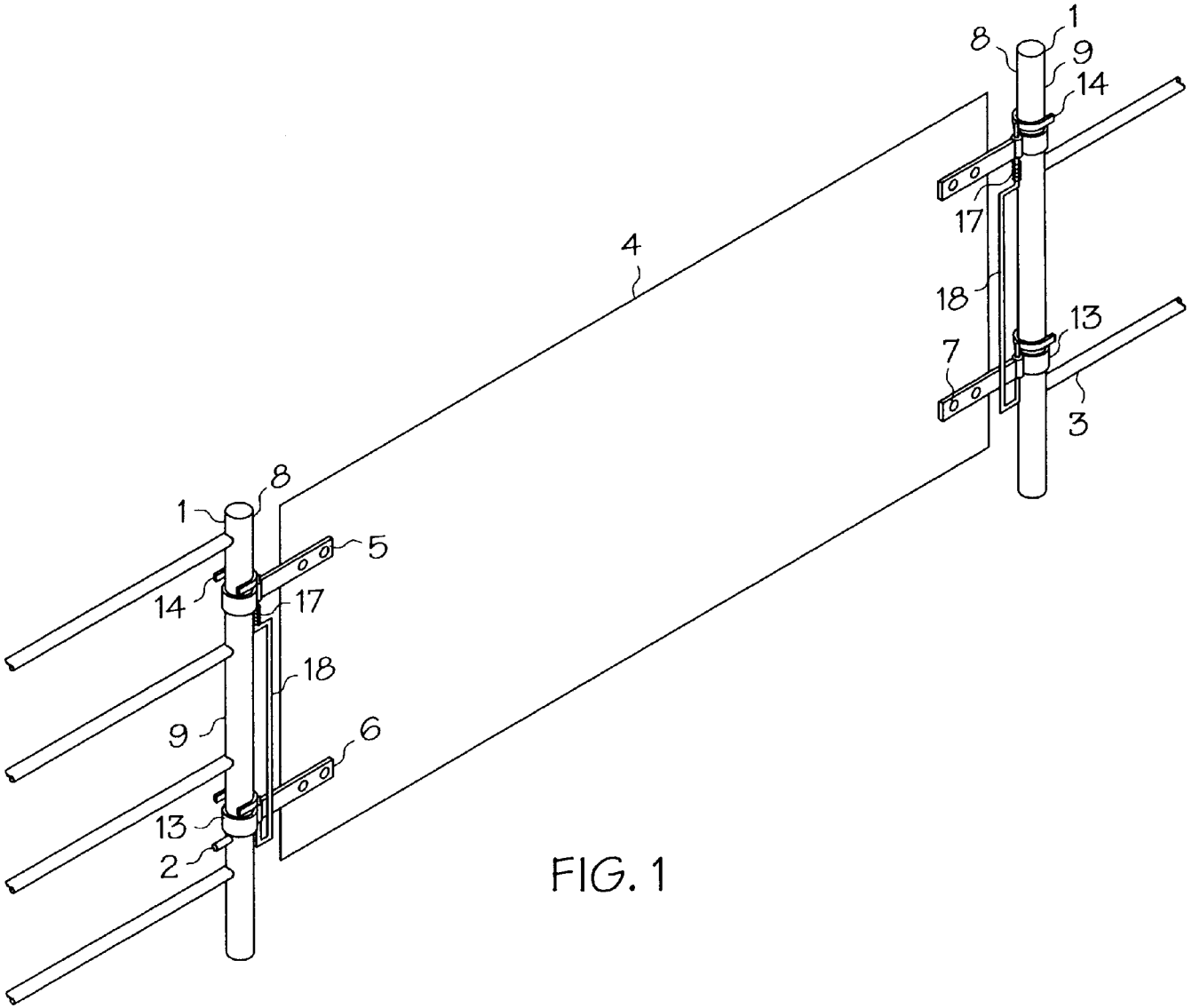
FIG. 1 is a perspective view of the preferred embodiment.

FIG. 1 shows a preferred embodiment of the invention. The vertical columns 1 defining the gate opening are vertical cylindrical tubes. The columns could have a rectilinear cross-section such as an octagon, upon which the gate could pivot, however it will be apparent to those skilled in the art that a cylinder is the most functional cross-section. It is therefore most convenient to provide a cylindrical tube for the columns 1.

Gate panel 4 may be any gate or door mounted in an opening in a fence as shown or in a wall or other structure. U-shaped upper hinge members 5 extend from upper portions of each end of the gate panel 4 and similarly U-shaped lower hinge members 6 extend from lower portions of each end of the gate panel 4. These hinge members 5 and 6 are fixed to the gate panel 4 by bolts through slotted holes 7, thereby allowing them to be adjusted closer to or farther away from the gate panel 4. Thus some degree of bending or deformity of the gate panel 4 or vertical columns 1 may be accommodated.

It can be seen that the open ends of the hinge U's 13 of the hinge members 5 and 6 are aligned towards one side of the gate panel 4 and also aligned with the vertical columns 1 such that when the gate is closed, each hinge U 13 engages a vertical column 1 such that a first leg thereof lies on the inner side 8 of one of the vertical columns 1, substantially perpendicular to the opening and the second leg thereof lies on the outer side 9 of one of the vertical columns 1, substantially perpendicular to the opening. This can best be seen in FIG. 7.

FIG. 1 also illustrates the support member. On the left side of the gate as illustrated, the support member is a support pin 2 extending from the outer side 9 of the vertical column 1. In this position the hinge member will be supported while the gate is opened, without risk of the open end of the hinge U 13 coming into alignment with the support pin 2. In this position as well there is the least interference with traffic near the gate.

On the right side of the gate as illustrated, the support member is a fence rail 3 which is part of the fence and also extends from the outer side 9 of the vertical column 1. Thus the support member may be part of the structure of the enclosure where it is convenient. The support member on each side of the gate serves to hold the gate panel 4 in the proper vertical position on the vertical columns 1. The gate may move up unless the hinge is obstructed.

Figure 3:
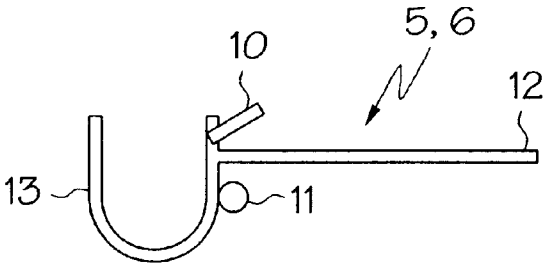
FIG. 3 is a top view of the hinge member of FIG. 2.
Figure 2:
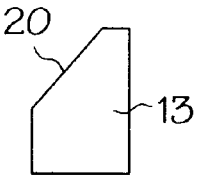
FIG. 2 is an end view of the hinge member.
Figure 4:
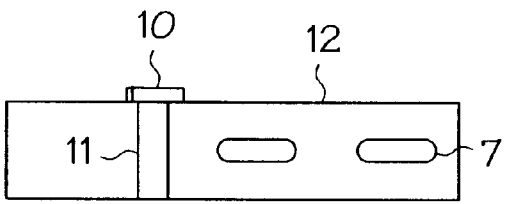
FIG. 4 is a side view of the hinge member of FIG. 2.

FIGS. 2, 3 and 4 illustrate the hinge members 5 and 6. The hinge U 13 is attached to a hinge bracket 12 which is attached to the gate panel 4 as shown in FIG. 1 by bolts through slotted holes 7. Block 10 is welded to the top of each hinge member 5,6 and serves to lock the gate closed as will be shown. Sleeve 11 is welded to the side of the hinge U 13 and serves as the pivot point for the latch as will be shown. The lower side of that leg of the hinge U 13 which rests on the support member is tapered 20 to facilitate the hinge U 13 riding up on top of the support pin 2 or fence rail 3 when the gate is pushed closed.

Figure 6:
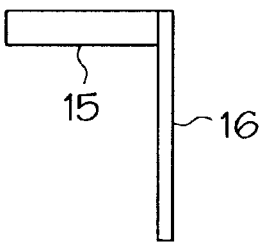
FIG. 6 is a side view of the latch member of FIG. 5.
Figure 5:
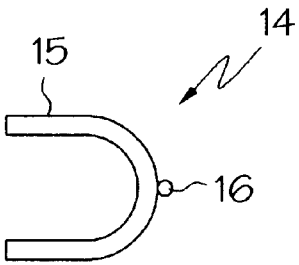
FIG. 5 is a top view of the latch member.

FIGS. 5 and 6 illustrate the U-shaped latch member 14, which comprises a latch U 15 welded to a latch pin 16.

Figure 7:
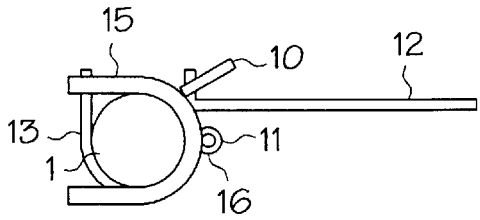
FIG. 7 is a top view of the hinge and latch members in the closed position about a vertical column.
Figure 8:
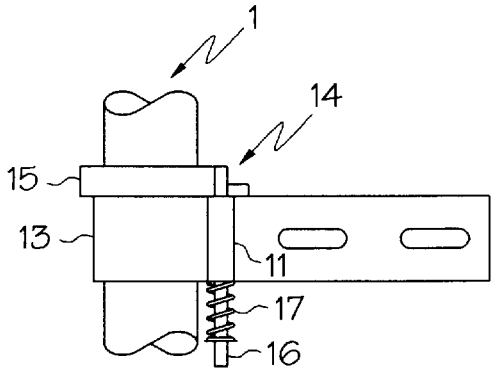
FIG. 8 is a side view of the hinge and latch members in FIG. 7.

FIGS. 7 and 8 illustrate the mechanism engaged about a vertical column 1 in the closed position. The legs of the latch U 15 are substantially perpendicular to the legs of the hinge U 13 thereby providing coverage about three quarters of the circumference of the vertical column 1. The gate panel 4 fixed to the hinge members 5,6 is thereby allowed to rotate about vertical column 1 while being maintained in firm engagement therewith. Thus the opposite end of the gate panel 4 may be swung open. The latch pin 16 is engaged in the sleeve 11 where it may freely rotate and move up and down. In the illustrated closed position the latch member 14 is in its lowest position resting on top of the hinge member 5,6, and is locked into the closed position by the block 10 which prevents the latch U 15 from pivoting.

Figure 9:
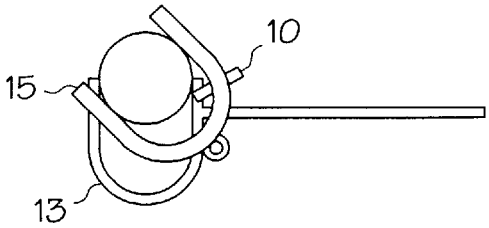
FIG. 9 is a top view of the hinge and latch members in a partially open position about a vertical column.
Figure 10:
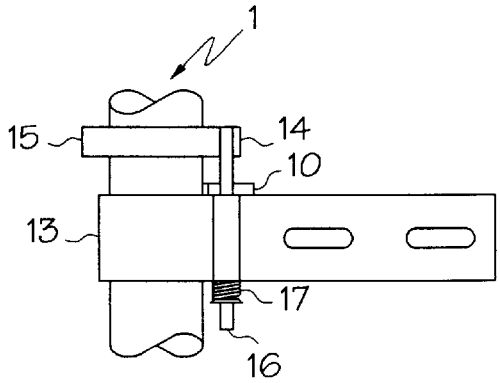
FIG. 10 is a view of the hinge and latch members in FIG. 9.

FIGS. 9 and 10 illustrate the partially open position. The latch pin 16 has been pushed upwards thereby raising the latch U 15 above the block 10 and so permitting same to pivot towards the open position as the gate panel 4 and hinge members 5,6 are moved away from the vertical column 1.

Figure 11:
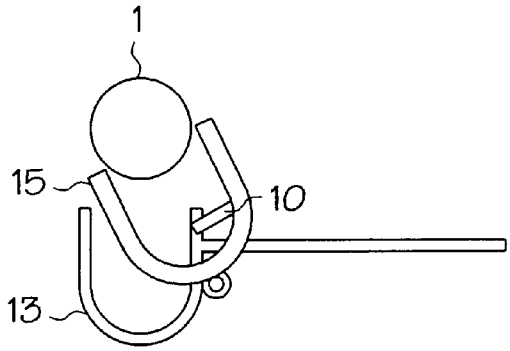
FIG. 11 is a top view of the hinge and latch members in the open position adjacent to a vertical column.

FIG. 11 illustrates the fully open position wherein the legs of the latch U 15 have pivoted to an acute angle to legs of the hinge U 13, and are clear of the vertical column 1. It can be seen in this FIG. 11 that when the gate panel 4 and hinge members 5,6 are moved towards the vertical column 1 to close the gate, the vertical column 1 contacts the inside leg of the latch U 15, causing it to pivot towards the closed position, as can be seen by following back from the position of FIG. 11 to that of FIG. 9 and then of FIG. 7. When the position of FIG. 7 is reached, the latch U 15 falls to the top of the hinge member 5,6 and is held in place by the block 10. In the present embodiment this fall is aided by a biassing force supplied by spring 17 acting in a downward direction against latch pin 16. The biassing force ensures that the latch U 15 goes down to rest on the hinge member 5,6 where it is locked by the block 10.

As illustrated in FIG. 1, control bar 18 joins the latch pins 16 on each end of the gate panel 4 so that when the control bar 18 is raised, both latch U's 15 on that end are moved up so they can pivot to the open position.

Figure 12:
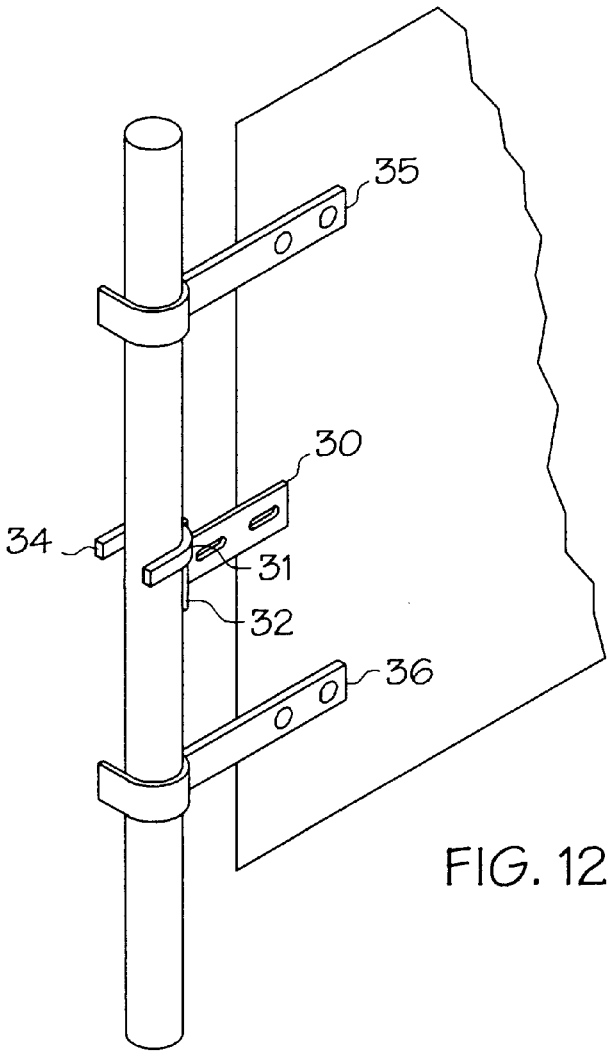
FIG. 12 is a perspective view of an alternate embodiment comprising a single latch member mid-way between the two hinge members at one end of a gate panel.

FIG. 12 illustrates an alternate embodiment which could be used for a lighter duty application. The upper and lower hinge members 35, 36 and latch member 34 are the substantially the same as those illustrated in FIGS. 2 to 6, however only one latch member 34 is utilized and located approximately midway between the upper and lower hinge members 35, 36. The block (not shown) to lock the latch member in the closed position, and the sleeve 31 to accommodate the pin 32 of the latch member 34 are located on a latch bracket 30 rather than on the hinge members.

This embodiment illustrates the principle of the gate which simply requires that some latch mechanism be provided to hold the hinge U's 13 into engagement with the vertical columns 1. This mechanism may be located and act at any point along the vertical column so long as it exerts a force that holds the hinge members and vertical column together.

Figure 13:
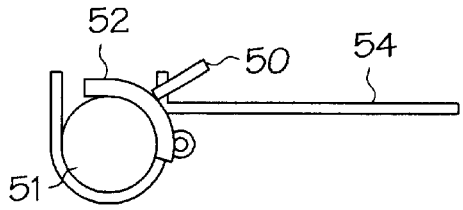
FIG. 13 is a top view of an alternate embodiment wherein the legs of the U-shaped latch member are separated by a vertical distance.
Figure 14:
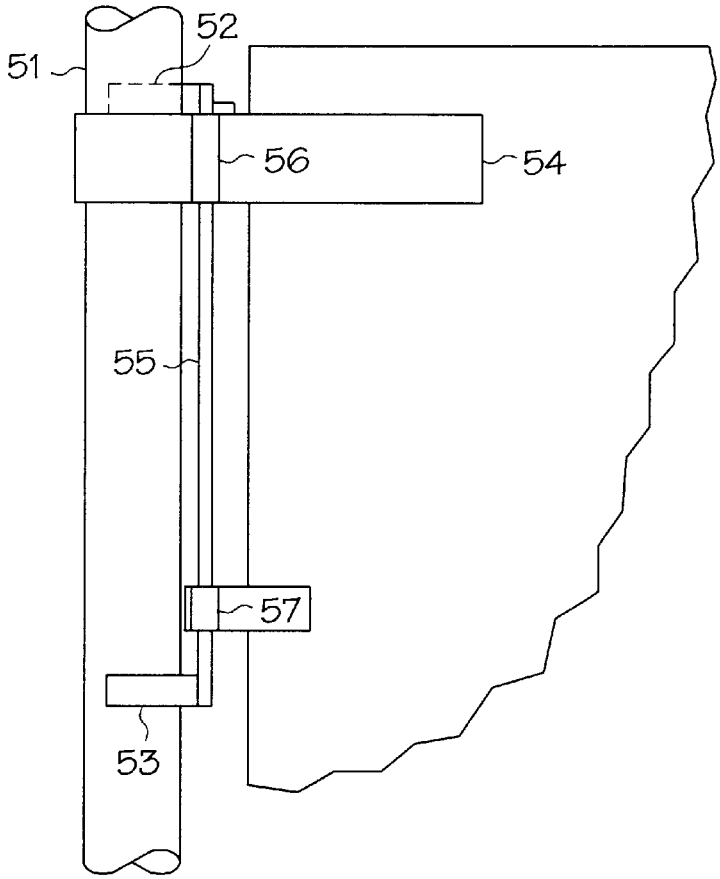
FIG. 14 is a side view of the embodiment of FIG. 13.

FIGS. 13 and 14 illustrate another alternate embodiment. The hinge member 54 is identical to that illustrated in FIGS. 2, 3 and 4, and acts to lock the latch U into the closed position in the same manner. The clamp leg 52 and push leg 53 of the latch U are, however, vertically separated, but it can be seen that the action of the latch member is the same. The push leg 53 is first contacted by the vertical post 51 as the gate is pushed closed and pivots to bring the clamp leg 52, which is rigidly attached to the push leg 53, into engagement with the vertical column 51, at which point the latch member drops and the clamp leg 52 is locked behind the block 50. The latch pin 55 passes through sleeve 56 on the hinge member 54 and is supported near the lower push leg by lower sleeve 57. The latch pin 55 is biassed by conventional means (not shown) and a control rod (not shown) moves the upper and lower latch members together.

Figure 15:
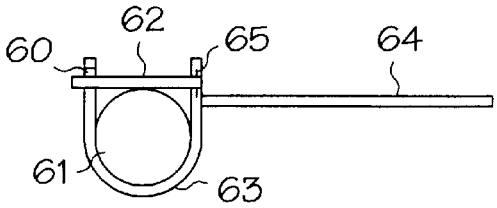
FIG. 15 is a top view of an alternate embodiment comprising a bar which may pivot to lock the hinge member into engagement with the vertical column.

FIG. 15 illustrates a simple embodiment of the invention which does not provide the automatic latching feature wherein the hinge member 64 is held in engagement with a vertical column 61 by a latch bar 62 which pivots on a pivot pin 65 one side of the hinge U 63. The latch bar 62 closes the open end of the hinge U 63, latching it into a closed position. The latch bar 62 drops behind block 60, and is manually pivoted upwards to release the hinge U 63 and open the gate.

It can be seen that the hinge members, latch members, support members and controls could easily be packaged as a kit for installation on any closure means where two-way hinging was desirable. The assemblies as illustrated in FIG. 1 would require only two bolt holes in each corner of the gate panel to be installed, and any common cylindrical tubing would suffice for the ends of the opening. The support member could then be installed to the tubing.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A gate assembly comprising:

a pair of spaced vertical columns;

a gate panel having two opposed vertical sides and disposed between said vertical columns;

at least one U-shaped hinge member having a hinge-U and a bracket, said bracket attached to each side of said gate panel, said hinge-U positioned for engagement with one of said vertical columns;

a hinge support member extending from each said vertical column engagable with a bottom edge of said at least one U-shaped hinge member in a closed position;

at least one U-shaped latch member having a latch-U pivotally attached on each side of said gate panel, each said latch-U having latch-U legs and an open end and each said hinge-U having hinge-U legs and an open end whereby said latch-U legs are movable from an acute angle relative to said hinge-U legs so that said open end of said hinge-U and said open end of said latch-U are in alignment to receive one of said vertical columns when in an open position to a substantially perpendicular position relative to said hinge-U legs when in said closed position engaging one of said vertical columns; and, a control device cooperating with said latch member to lock said latch member in said closed position and releasing said latch member to an open position.

2. The gate assembly of claim 1 wherein said control device includes a latch pin fixedly attached to an outer surface of said latch-U adjacent a closed end of said latch-U and a vertically extending sleeve attached to an outer surface of said hinge-U, said latch pin being received within said sleeve.

3. The gate assembly of claim 2 including said at least one U-shaped hinge member and said at least one U-shaped latch member attached to each side of said gate panel in a top section of said gate panel and said at least one U-shaped hinge member and said at least one U-shaped latch member attached to a side of a lower section of said gate panel.

4. The gate assembly of claim 3 wherein said control device further includes a vertical lifting control bar attached at opposite ends to said latch pin in said lower portion of said gate panel and said latch pin in said upper portion of said panel.

5. The gate assembly of claim 2, said control device having a latching means positioned to engage said latch-U.

6. The gate assembly of claim 5 wherein said control device includes a block attached to a top of an inner leg of said hinge-U legs, said block being spaced from said latch pin toward said open end of said hinge-U, said block having a spacing from one of said vertical columns when said latch member is in said closed position, said spacing being sufficient to receive said latch-U therein when said latch member is in said closed position, whereby when said latch pin is in a bottom vertical position said block prevents pivoting of said latch member until said latch pin is moved to a raised position to allow said latch member to pivot over the top of said block and rest on said block in said open position.

7. The gate assembly of claim 6 wherein said latch member is positioned vertically above said U-shaped hinge member, said block being fixed to the top of said hinge-U.

8. The gate assembly of claim 6 further comprising a bias element urging said latch pin into said bottom vertical position.

9. The gate assembly of claim 1 including said at least one U-shaped hinge member and said at least one U-shaped latch member attached to each side of said gate panel in a top section of said gate panel and said at least one U-shaped hinge member and said at least one U-shaped latch member attached to a side of a lower section of said gate panel.

* * * * *